United States Patent [19]

Gammache

[11] Patent Number: 4,807,097

[45] Date of Patent: Feb. 21, 1989

[54] MINIATURE FLASHLIGHT

[76] Inventor: Richard J. Gammache, 1564 Mission Rd., Lancaster, Pa. 17601

[21] Appl. No.: 154,895

[22] Filed: Feb. 11, 1988

Related U.S. Application Data

[62] Division of Ser. No. 863,111, May 14, 1986, Pat. No. 4,725,932.

[51] Int. Cl.[4] ..... F21L 7/00

[52] U.S. Cl. ..... 362/202; 362/205; 362/187; 200/60

[58] Field of Search ..... 362/157, 202, 203, 205, 362/208, 204, 158, 187, 188; 200/60

[56] References Cited

U.S. PATENT DOCUMENTS

| | | | |
|---|---|---|---|
| 3,671,734 | 6/1972 | Angiband | 362/202 |
| 3,835,272 | 9/1974 | Wisenbaker | 200/60 |
| 4,286,311 | 8/1981 | Maglica | 362/187 |
| 4,577,263 | 3/1986 | Maglica | 362/205 |
| 4,581,686 | 4/1986 | Nelson | 362/204 |
| 4,725,932 | 2/1988 | Gammache | 362/202 |

FOREIGN PATENT DOCUMENTS

| | | | |
|---|---|---|---|
| 812980 | 5/1959 | United Kingdom | 362/202 |
| 2091863 | 8/1982 | United Kingdom | 362/205 |

*Primary Examiner*—Ira S. Lazarus
*Assistant Examiner*—D. M. Cox

[57] ABSTRACT

A miniature flashlight utilizes a standard type of bulb commonly used in standard size flashlights. In the preferred embodiment, the miniature flashlight includes a cylindrical casing containing a pair of batteries. A bulb disposed in the casing has a first terminal connected to the positive terminal of one of the batteries. The bulb has a cylindrical metallic base with an integral annular flange that forms a second terminal of the bulb. The casing carries a conductive flange for contacting the annular flange of the bulb in order to illuminate the bulb. The miniature flashlight of the preferred embodiment also includes a shuttle switch formed of nonconductive material which is operable for extinguishing the bulb by moving the bulb in a direction which moves its annular flange away from the conductive flange on the casing. The shuttle switch is generally ring shaped with a plurality of lugs for engaging the annular flange of the bulb.

6 Claims, 4 Drawing Sheets

MINIATURE FLASHLIGHT

This is a division of application Ser. No. 863,111, filed May 14, 1986, now U.S. Pat. No. 4,725,932.

BACKGROUND OF THE INVENTION

This invention relates generally to flashlights and, in particular, to a miniature flashlight.

Typically, miniature flashlights such as disclosed in U.S. Pat. No. 4,577,263 utilize small batteries commonly referred to as "pen light" batteries. These miniature flashlights usually include a cylindrical casing for holding the batteries, a miniature bulb, and a head assembly rotatably mounted on the casing for turning the bulb "on" and "off". The head assembly is movable longitudinally of the casing to focus the beam of light emitted by the bulb. Rotation of the head assembly in one direction permits the electrical circuit through the flashlight to be closed thereby illuminating the bulb. Conversely, rotation of the head assembly in the opposite direction opens the electrical circuit thereby extinguishing the bulb. A drawback of known miniature flashlights is that they require the use of specially constructed miniature bulbs which are not always readily available to the average consumer.

SUMMARY OF THE INVENTION

Therefore, it is an object of the present invention to provide a miniature flashlight that uses a standard flashlight bulb of the type used in standard size flashlights.

According to one embodiment of the present invention, a flashlight includes a casing containing at least one battery. A bulb disposed in the casing has a first terminal connected to the battery and a second terminal. The flashlight also includes conductive means on the casing for contacting the second terminal of the bulb to thereby close an electrical circuit for illuminating the bulb. A shuttle switch formed of nonconductive material is operable for moving the bulb in a direction which moves its second terminal out of contact with the conductive means to thereby open the electrical circuit for extinguishing the bulb. The flashlight further includes a head assembly movably mounted on the casing for operating the shuttle switch.

According to another embodiment of the present invention, a flashlight includes nonconductive means on the casing for contacting the second terminal of a bulb to open the electrical circuit for extinguishing the bulb. A shuttle formed of conductive material is operable for contacting the second terminal of the bulb to close the electrical circuit for illuminating the bulb. The head assembly of the flashlight is movably mounted on the casing for operating the shuttle.

Preferably, the bulb used in the flashlight of the present invention is a standard type of bulb which has a cylindrical metallic base with an annular flange that forms the second terminal of the bulb. The shuttle switch is generally ring shaped and has a plurality of lugs adapted for engaging the annular flange of the bulb. The head assembly includes a flat annular surface or a wavy cam surface for engaging the lugs of the shuttle switch.

DESCRIPTION OF THE INVENTION

Figures 1, 2, 3, 4:
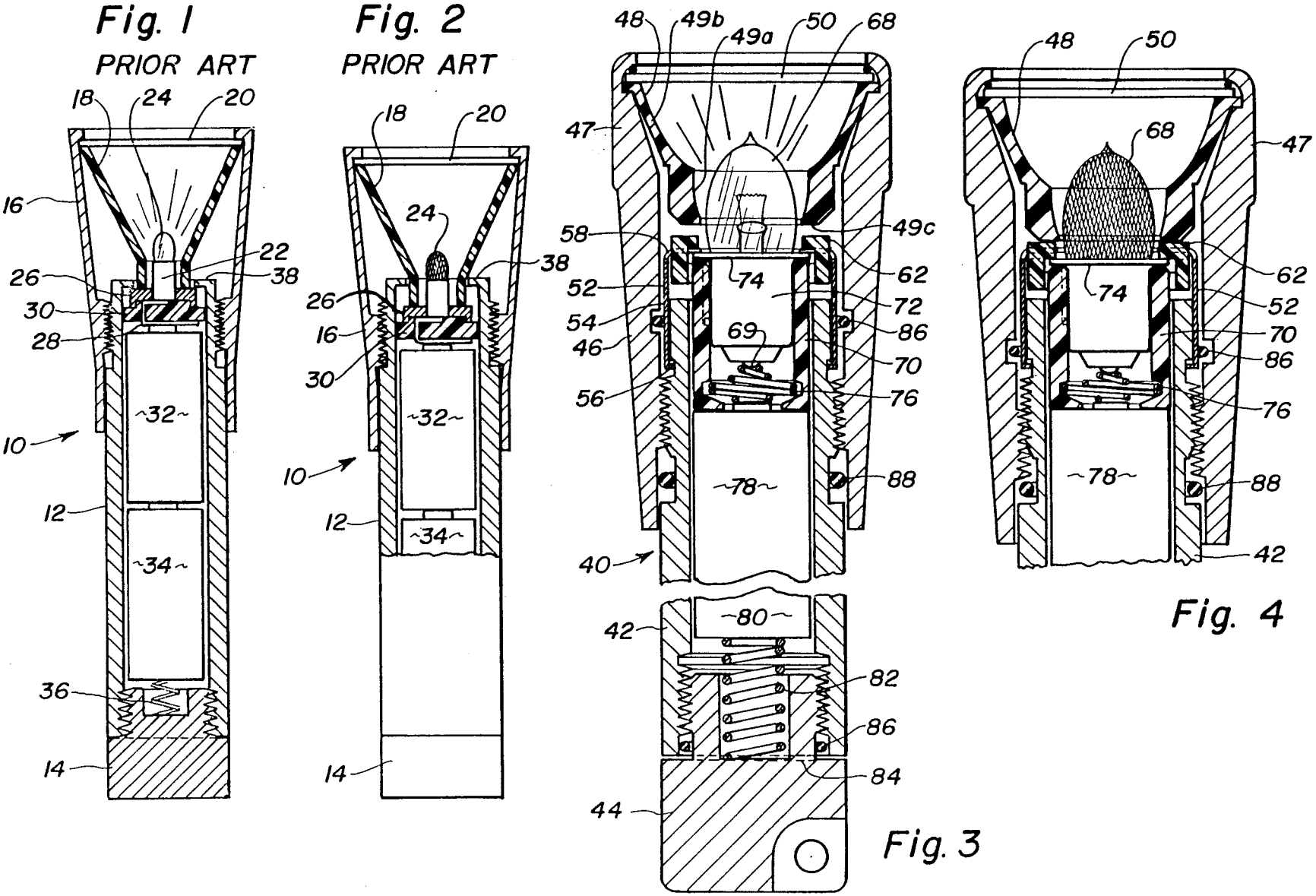
Fig. 1 PRIOR ART
Fig. 2 PRIOR ART
FIG. 1 is a cross-sectional view of a flashlight according to the prior art with the bulb thereof illuminated.
FIG. 2 is a cross-sectional view of the flashlight of FIG. 1 with the bulb thereof extinguished.
FIG. 3 is a cross-sectional view of a flashlight according to the preferred embodiment of the present invention with the bulb thereof illuminated.
FIG. 4 is a cross-sectional view of the flashlight of FIG. 3 with the bulb thereof extinguished.

Referring to FIG. 1, a miniature flashlight 10 according to the prior art includes a cylindrical casing 12 formed of conductive metal. The casing 12 is closed at its lower end by a metal tail cap 14 that is threaded into the casing 12. The flashlight 10 also includes a head assembly 16 threaded onto the upper end or the casing 12. A plastic reflector 18 and a lens 20 are mounted in the head assembly 16, and a bulb assembly 22 is mounted in the casing 12.

The bulb assembly 22 consists of a miniature bulb 24 disposed in a metallic base member 26. A metallic conductor 28 extends from the bulb 24 through a plastic insulator member 30 for engagement with the positive electrode of a battery 32 which is contained in the casing 12. Another battery 34 is also contained in the casing 12 connected in series with battery 32. A metallic spring 36 extends between the negative electrode of the battery 34 and the tail cap 14. The spring 36 urges the batteries 32, 34 in an upward direction in FIG. 1 which causes the base member 26 to contact an annular flange 38 integrally formed on the upper end of the casing 12. This closes the electrical circuit in the flashlight 10 illuminating the bulb 24.

Rotation of the head assembly 26 from the position shown in FIG. 1 in a direction which moves it away from the tail cap 14 focuses the beam of light emitted by the bulb 24. When the head assembly 26 is subsequently rotated in a direction which moves it toward the tail cap 14, the reflector 18 engages the base member 26 as seen in FIG. 1, and then pushes the base member 26 away from the annular flange 38 of the casing 12 as seen in FIG. 2 upon further rotation of the head assembly 26 in the same direction. This opens the electrical circuit in the flashlight 10 extinguishing the bulb 24.

Figure 5:
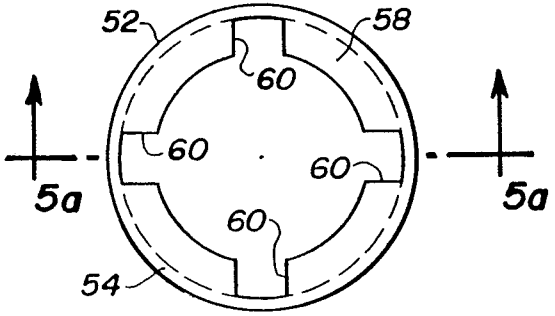
FIG. 5 is a top plan view of one of the parts of the flashlight of FIG. 3.
Figure 5A:
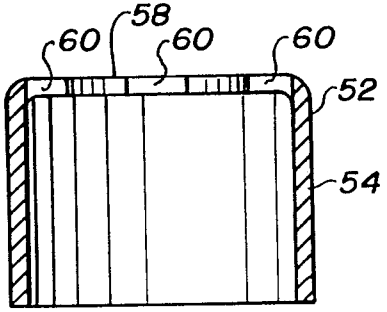
FIG. 5*a* is a partial sectional view taken along lines 5*a*–5*a* in FIG. 5.

Referring now to FIG. 3, a flashlight 40 according to the preferred embodiment of the present invention includes a cylindrical metal casing 42, a metal tail cap 44 threaded into the lower end of the casing 42, and a head assembly 46 threaded onto the upper end of the casing 42. The head assembly 46 consists of a metal shell 47 which carries a plastic reflector insert 48 and a lens 50. A metallic switch retainer 52, preferably formed of thin steel, is permanently fixed to the upper end of the casing 42. The switch retainer 52 has a cylindrical wall 54 with an annular lip 56 at the bottom of the wall 54 pressed into engagement with a complimentary shoulder formed on the casing 42. As best seen in FIGS. 5 and 5*a*, the switch retainer 52 also has an annular flange 58 at the top of the wall 54. Four slots or cutouts 60 are provided in the flange 58.

Figure 6:
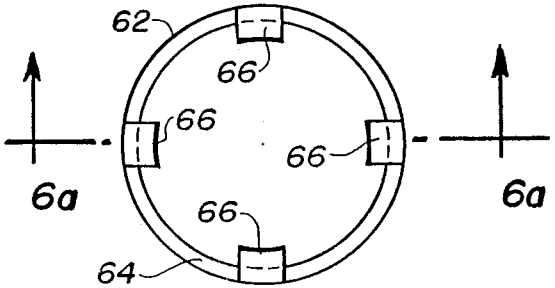
FIG. 6 is a top plan view of another part of the flashlight of FIG. 3.
Figure 6A:
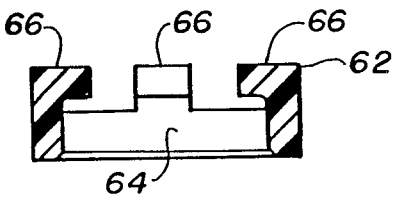
FIG. 6*a* is a partial sectional view taken along lines 6*a*–6*a* in FIG. 6.

A shuttle switch 62 formed of nonconductive material such as fiberglass filled nylon, is slidably mounted in the switch retainer 52. As best seen in FIGS. 6 and 6*a*, the shuttle switch 62 is generally ring shaped with an annular wall 64 sized to fit within the cylindrical wall 54 of the switch retainer 52 and four lugs 66 sized to fit within the four slots 60 formed in the flange 58 of the switch retainer 52.

A standard flashlight bulb 68 is removably mounted in a bulb carrier 70 which is preferably formed of a nonconductive plastic material. The bulb 68 has a cylindrical metallic base 72 provided with an integrally formed annular flange 74. The bulb 68 may be keyed to the bulb carrier 70 in conventional manner to prevent rotation of the bulb 68 within the bulb carrier 70. Bulb 68 is preferably a readily available PR style incandescent bulb. However, bulb 68 may also be a krypton halogen or other high intensity type of bulb.

A double conical coil spring 76, formed of metal and mounted in a groove in the bulb carrier 70, extends between a first terminal 69 of bulb 68 and the positive terminal of a battery 78 (only partly shown in FIG. 3) that is contained in the casing 42. The flashlight 40 preferably includes another battery 80 (only partially shown in FIG. 3) also contained within casing 42 and in series with battery 78. A metallic coil spring 82 is compressed between the negative terminal of battery 80 and a copper insert 84 mounted in the tail cap 44.

The spring 82 urges the batteries 78, 80 and the bulb carrier 70 in an upward direction in FIG. 3 causing the flange 74 which forms a second terminal of bulb 68 to contact the flange 58 of the switch retainer 54 when the head assembly 46 is located in the position shown in FIG. 3. This closes the electrical circuit in the flashlight 40 thereby illuminating the bulb 68. Current flows from the batteries 78, 80 through the spring 76 into the bulb 68, and then through the bulb 68 into the switch retainer 52 via the abovementioned contact between the flanges 58 and 74. The current then flows through the switch retainer 52, casing 42, tail cap 44, copper insert 84 and spring 82 to the battery 80.

Rotation of the head assembly 46 from the position shown in FIG. 3 in a direction that moves it away from tail cap 44 focuses the beam of light emitted by the bulb 68. Since the bulb 68 is considerably larger than the bulb 24 used in the prior art flashlight 10 of FIGS. 1 and 2, the reflector insert 48 has two distinct parabolic surfaces 49*a*, 49*b* arranged for proper dispersion of the light. O-rings 86, 88 are provided to seal the flashlight 40.

When the head assembly 46 is subsequently rotated from the position shown in FIG. 3 in a direction which moves it toward the tail cap 44, a flat annular surface 49*c* formed on the bottom of the reflector insert 48 engages the lugs 66 of the shuttle switch 62. Further rotation of head assembly 46 in the same direction pushes the shuttle switch 62 downwardly in FIG. 3. The lugs 66 of the shuttle switch 62 pass through the slots 60 in the flange 58 of the switch retainer 52 and then engage the flange 74 of bulb 68. Continued movement of the head assembly 46 toward the tail cap 44 pushes the bulb 68, bulb carrier 70 and batteries 78, 80 down into the casing 42 against the compressive force of the spring 82. This moves the flange 74 of the bulb 68 away from the flange 58 of the switch retainer 52 as shown in FIG. 4, and thus opens the electrical circuit in the flashlight 40 thereby extinguishing the bulb 68.

Subsequent rotation of the head assembly 46 in the opposite direction moves it away from the tail cap 44. When the head assembly 46 approaches the position shown in FIG. 3, the bulb 68 is moved upward so that the flange 74 thereof contacts the switch retainer flange 58 thereby illuminating the bulb 68. The shuttle switch 62 is returned to the position shown in FIG. 3.

Figure 7:
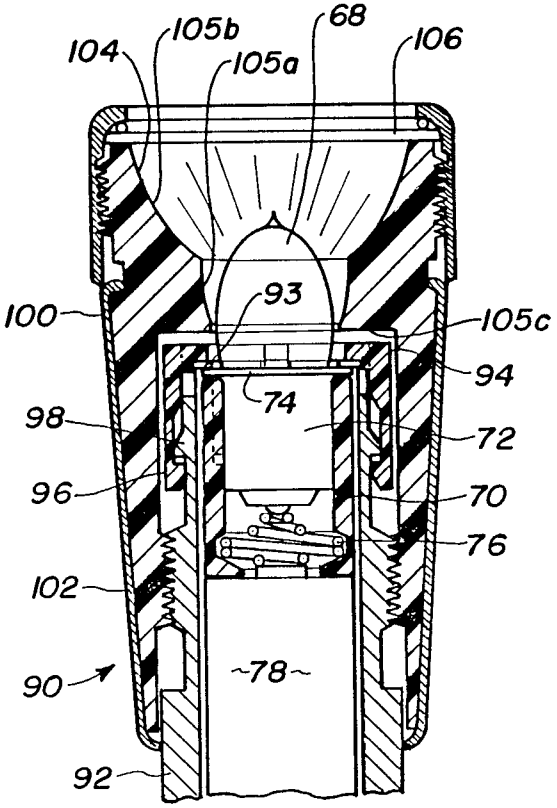
FIG. 7 is a cross-sectional view of a flashlight according to an alternative embodiment of the present invention with the bulb thereof illuminated.

Referring to FIG. 7, a flashlight 90 according to an alternative embodiment of the present invention includes a metal casing 92, the upper end of which is provided with an annular flange 93 similar to the annular flange 38 formed on casing 12 of prior art flashlight 10 but with four slots provided therein similar to the slots 60 formed in switch retainer 52 of flashlight 40. A shuttle switch 94 formed of nonconductive material is slidably mounted on the upper end of the casing 92. The shuttle switch 94 is similar to shuttle switch 62 of flashlight 40 in that it has four lugs similar to lugs 66 which fit in the aforementioned slots formed in the annular flange 93 at the upper end of the casing 92. The shuttle switch 94 also has an annular lip 96 for engaging an annular shoulder 98 on the casing 92.

Flashlight 90 also includes a head assembly 100 consisting of a metallic outer shell 102 and a plastic inner shell 104 which is threaded onto the casing 92. The inner shell 104 has reflective surfaces 105*a*, 105*b* for dispersing the light emitted by bulb 68. Head assembly 100 also consists of a removable lens 106 secured by a cap 108 which is threaded onto the inner shell 104.

When the head assembly 100 is in the position shown in FIG. 7, the bulb 68 is pushed upward so that the flange 74 thereof contacts the flange 93 on the casing 92. This closes the electrical circuit in the flashlight 90 thereby illuminating the bulb 68. Current flows through the flashlight 90 in a path which is similar to the path of current flow in flashlight 40.

Figure 8:
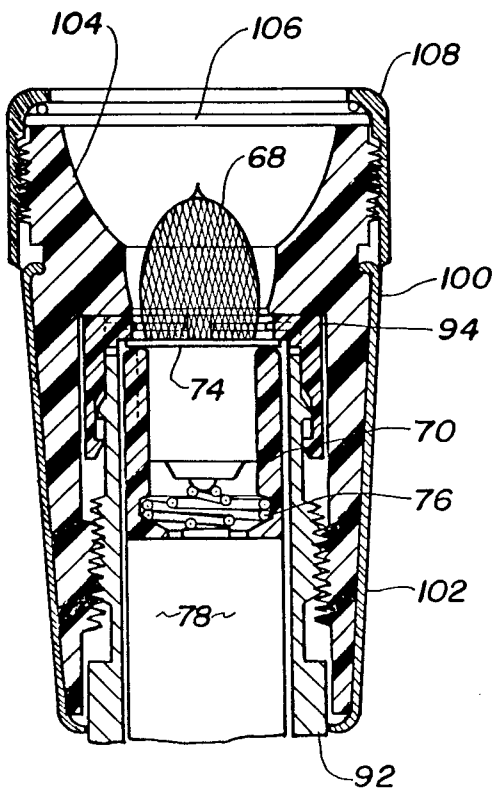
FIG. 8 is a cross-sectional view of the flashlight of FIG. 7 with the bulb thereof extinguished.

Rotation of the head assembly 100 in a direction that moves it downward in FIG. 7 causes a flat annular surface 105*c* on the inner shell 104 of the head assembly 100 to contact the lugs of the shuttle switch 94. Further rotation of the head assembly 100 in the same direction pushes the shuttle switch 94 downward. The lugs of the shuttle switch 94 pass through the slots in the flange 93 of the casing 92 and into engagement with the flange 74 of bulb 68. Continued rotation of the head assembly 100 in this same direction pushes the bulb 68 downward so that the flange 74 thereon is moved away from the flange 93 of casing 92 as seen in FIG. 8. This opens the electrical circuit in the flashlight 90 thereby extinguishing the bulb 68.

Subsequent rotation of the head assembly 100 in the opposite direction moves it upward in FIG. 8. When the head assembly 100 approaches the position shown in FIG. 7, the bulb 68 is moved upward so that the flange 74 thereof contacts the casing flange 93 thereby illuminating the bulb 68. The shuttle switch 94 is also returned to the position shown in FIG. 7.

Figure 9:
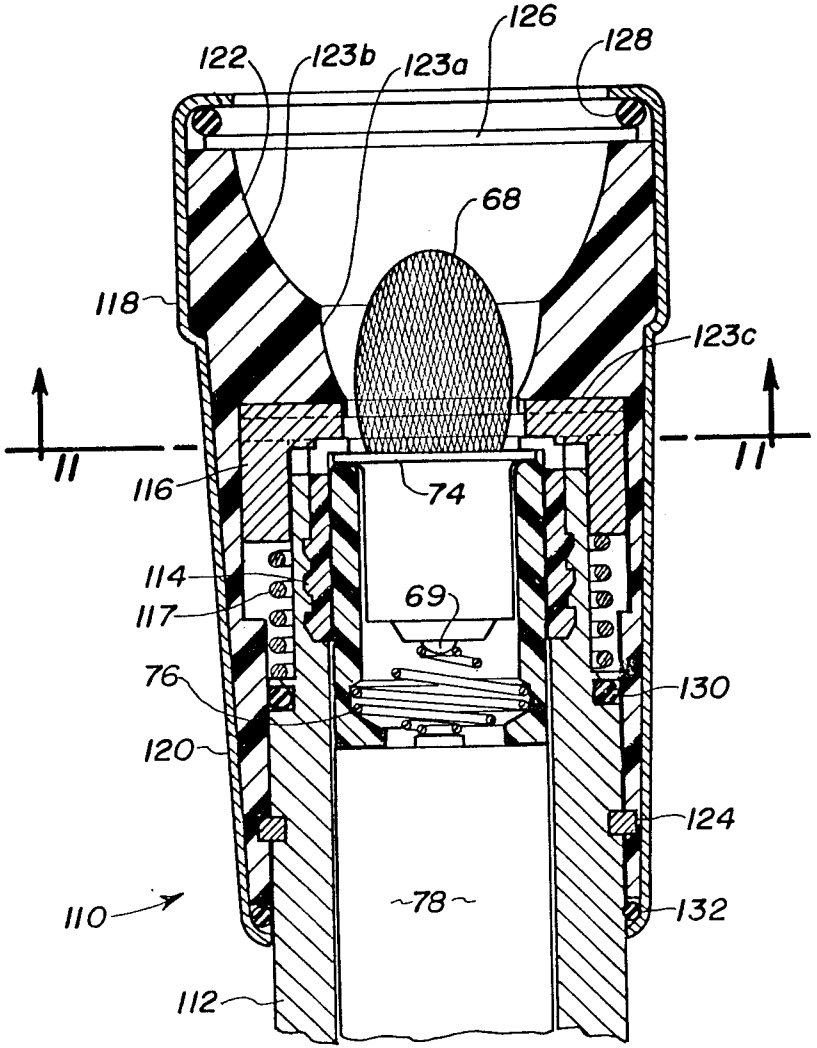
FIG. 9 is a cross-sectional view of a flashlight according to another alternative embodiment of the present invention with the bulb thereof extinguished.
Figure 11:
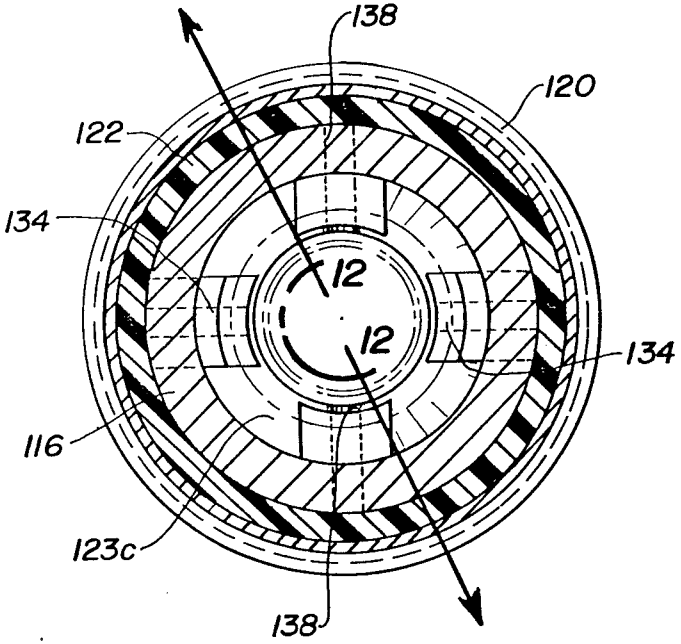
FIG. 11 is a sectional view taken along lines 11—11 in FIG. 9.

Referring to FIG. 9, a flashlight 110 according to another alternative embodiment of the present invention includes a metal casing 112 with a plastic sleeve 114 inserted in its upper end. The sleeve 114 is similar to switch retainer 52 of flashlight 40 in that it has an annular flange which is similar to annular flange 58 provided with four slots or cutouts which are similar to slots 60. The upper end of the casing 112 has four slots formed therein aligned with the four slots in the flange of the sleeve 114. A shuttle 116 formed of conductive metal is slidably mounted on the upper end of the casing 112. The shuttle 116 is similar to shuttle switch 62 of flashlight 40 in that it has four lugs similar to lugs 66 which will fit in the aforementioned slots in the sleeve 114 and the casing 112. A metallic spring 117 is compressed between the shuttle 116 and the casing 112.

Flashlight 110 also includes a head assembly 118 consisting of a metal outer shell 120 and a plastic inner shell 122 which is permanently secured to the casing 112 by a retaining ring 124. The inner shell 122 has reflective surfaces 123*a*, 123*b* for dispersing the light from bulb 68 and a wavy cam surface 123*c* for causing movement of the shuttle 116 when the head assembly 118 is rotated on the casing 112. The head assembly 118 also consists of a lens 126. O-rings 128, 130, 132 are provided to seal the flashlight 110.

Figure 12A:
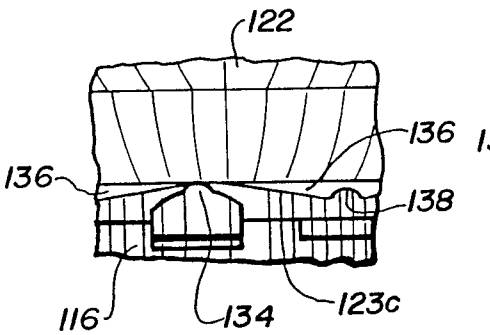
FIGS. 12*a* and 12*b* are schematic radial views taken along lines 12—12 in FIG. 11.
Figure 12B:
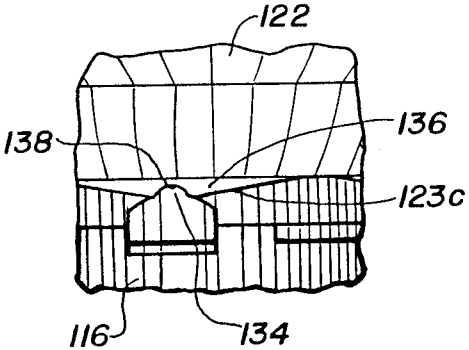

The shuttle 116 includes a pair of diametrically opposed tabs 134, one of which is shown in FIGS. 12*a* and 12*b*, formed on the top of two of the lugs which are diametrically opposed. The tabs 134 ride against the cam surface 123*c* on the inner shell 122 of the head assembly 118. When the tabs 134 are in the position illustrated in FIG. 12*a* where they are located at the "low" point of the cam surface 123*c*, the shuttle 116 is in the position shown in FIG. 9 and the flange 74 of bulb 68 is in contact with the annular flange on the sleeve 114. This opens the electrical circuit in the flashlight 110 thereby extinguishing the bulb 68.

Figure 10:
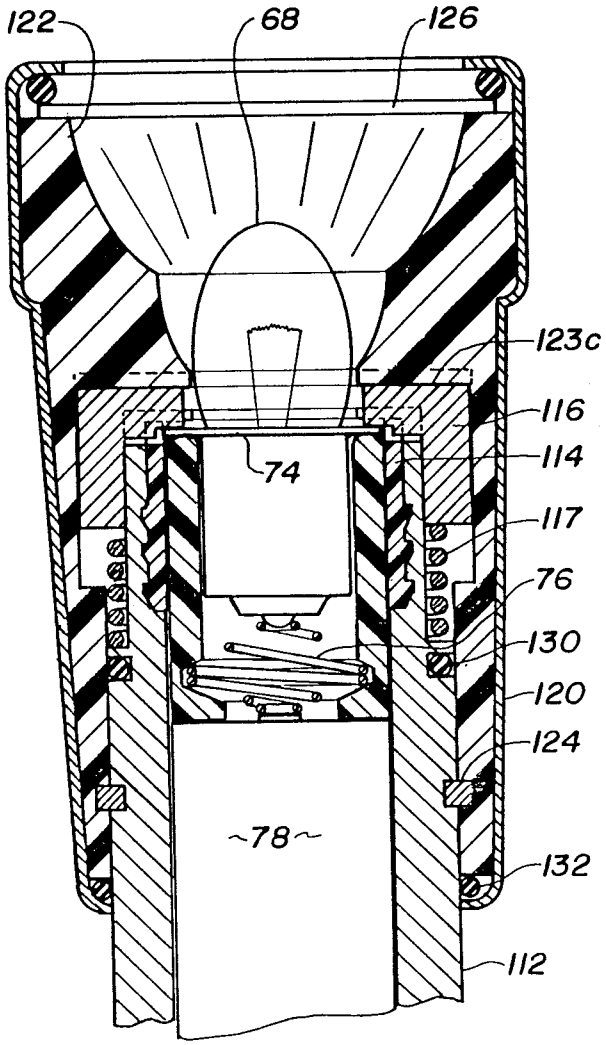
FIG. 10 is a cross-sectional view of the flashlight of FIG. 9 with the bulb thereof illuminated.

Rotation of the head assembly 118 in either direction from the position shown in FIG. 9 causes the tabs 134 to ride up ramps 136 formed on the cam surface 123*c* of the inner shell 122. This moves the shuttle 116 downward in FIG. 9 into contact with the flange 74 of the bulb 68 as seen in FIG. 10 and thus closes the electrical curcuit in the flashlight 110 thereby illuminating the bulb 68. Current flows from the battery 78 through the spring 76 into the bulb 68, and then through the bulb 68 into the shuttle 116 due to the contact between the shuttle 116 and the bulb flange 74. The current flows through the spring 117 into the casing 112. Further rotation of the head assembly 118 in the same direction moves the shuttle 116 farther downward in FIG. 10 which in turn moves the bulb 68 downward. This further rotation of the head assembly 118 focuses the beam of light emitted by the bulb 68 Continued rotation of the head assembly 118 in the same direction causes the tabs 134 to reach the "high" point of the cam surface 123*c* where the tabs 134 drop into grooves 138 formed in the cam surface 123*c*. The engagement of the tabs 134 in the grooves 138 locks the bulb 68 in its illuminated condition.

Subsequent rotation of the head assembly 118 in the same or opposite direction causes the tabs 134 to disengage from the grooves 138 and ride down the ramps 136 to the "low" point of the cam surface 123*c*. This permits the spring 117 to push the shuttle 116 upwardly away from the flange 74 of the bulb 68. This opens the electrical circuit in the flashlight 110 thereby extinguishing the bulb 68. The shuttle 116 is returned to the position shown in FIG. 9.

It will be understood that the flashlights 90 and 110 according to the alternative embodiments of the present invention utilize the same tail cap 44 and spring 82 arrangement as the flashlight 40 of the preferred embodiment of the present invention. In all three flashlights 40, 90, and 110, the bulb 68 and the batteries 78, 80 may be removed by removing the tail cap 44 from the casings 42, 92, 112 and then sliding the batteries 78, 80, the bulb carrier 70 and the bulb 68 out the open end of the casings. A new bulb and new batteries may then be installed if desired.

All three flashlights 40, 90, and 110 utilize a double conical coil spring 76 to connect the first terminal 69 of the bulb 68 and the positive terminal of battery 78. This arrangement limits the force on the first terminal 69 of the bulb 68 to the compressive force of the spring 76.

Flashlights 40, 90, and 110 are preferably intended to use two size AA dry cell batteries. The total length of these flashlights will be approximately 6 inches and the diameter of their casings 42, 92, 112 will be approximagely $\frac{3}{4}$ inches. Flashlights 40, 90, and 110 are not, however, limited to this size battery or these dimensions.

It should be understood that terms such as "top", "bottom", "upper", "lower", "upward" and "downward" as used in the foregoing description refer to directions as seen in the drawings and are not intended to limit the present invention.

What is claimed is:

1. A flashlight comprising:

a casing containing at least one battery;

a bulb disposed in said casing, said bulb having a first terminal connected to said battery and a second terminal, said bulb having a cylindrical metallic base with an annular flange formed thereon, said flange comprising said second terminal;

nonconductive means on said casing for contacting the second terminal of said bulb to thereby open an electrical circuit for extinguishing said bulb;

a shuttle formed of conductive material, said shuttle being operable for contacting the second terminal of said bulb to thereby close said electrical circuit for illuminating said bulb, said shuttle being generally ring shaped and including a plurality of lugs for engaging the annular flange of said bulb; and a head assembly movably mounted on said casing for operating said shuttle, said head assembly having a wavy cam surface with ramps formed thereon for engaging tabs formed on the lugs of said shuttle.

2. The flashlight of claim 1, further comprising a sleeve mounted in one end of said casing, said sleeve being formed of nonconductive material and having a flange comprising said nonconductive means, said flange having a plurality of slots for receiving the lugs on said shuttle.

3. The flashlight of claim 1, further comprising a spring compressed between said shuttle and said casing for normally urging the lugs of said shuttle away from the annular flange of said bulb.

4. A flashlight comprising:

a casing containing at least one battery;

a bulb disposed in said casing, said bulb having a first terminal connected to said battery and a second terminal, said bulb having a base with an annular flange formed thereon, said flange comprising said second terminal;

nonconductive means on said casing for contacting the second terminal of said bulb to thereby open an electrical circuit for extinguishing said bulb;

a shuttle formed of conductive material, said shuttle being operable for contacting the second terminal of said bulb to thereby close said electrical circuit for illuminating said bulb, said shuttle being generally ring shaped and including a plurality of lugs for engaging the annular flange of said bulb; and a head assembly movably mounted on said casing for operating said shuttle without said head assembly being arranged to carry said bulb and without said head assembly forming part of said electrical circuit, said head assembly comprising a reflector insert having a wavy cam surface with ramps for engaging tabs on the lugs of said shuttle.

5. The flashlight of claim 4, wherein said head assembly is mounted on said casing for rotational movement relative to said casing.

6. The flashlight of claim 5, further comprising a spring connecting the first terminal of said bulb to said battery and normally urging the annular flange of said bulb into contact with said nonconductive means.

* * * * *